US005406774A

United States Patent [19]

Dodge

[11] Patent Number: 5,406,774

[45] Date of Patent: Apr. 18, 1995

[54] COMPRESSION PACKAGE WRAPPING APPARATUS AND METHOD

[75] Inventor: Bernard E. Dodge, Palatka, Fla.

[73] Assignee: Georgia Pacific Corporation, Atlanta, Ga.

[21] Appl. No.: 984,114

[22] Filed: Dec. 7, 1992

[51] Int. Cl.[6] ..... B65B 1/24; B65B 11/06

[52] U.S. Cl. ..... 53/436; 53/466; 53/528; 53/228; 53/230

[58] Field of Search ..... 414/671, 790; 53/228, 53/230, 232, 436, 466, 528, 541; 100/17, 18, 295

[56] References Cited

U.S. PATENT DOCUMENTS

| | | | |
|---|---|---|---|
| 1,816,085 | 7/1931 | Langhammer | 53/466 |
| 1,940,375 | 12/1933 | Smith et al. | 53/466 X |
| 2,653,433 | 9/1953 | Sandberg | 53/232 X |
| 3,006,119 | 10/1961 | Fingerhut . | |
| 3,080,691 | 3/1963 | Benner | 53/228 X |
| 3,212,230 | 10/1965 | Coates | 53/228 |
| 3,327,453 | 6/1967 | Willbrandt et al. | 53/228 |
| 3,747,295 | 7/1973 | Brinkmeier | 53/528 |
| 3,861,120 | 1/1975 | Gordon | 53/230 |
| 4,006,576 | 3/1977 | Tetenborg | 53/528 X |
| 4,035,990 | 7/1977 | Hallam | 53/228 X |
| 4,224,780 | 9/1980 | Rewitzer | 53/528 X |
| 4,279,116 | 7/1981 | James et al. | 53/466 |
| 4,522,013 | 6/1985 | Hamilton | 53/230 X |
| 4,622,802 | 11/1986 | Takamura | 53/466 |
| 4,730,441 | 3/1988 | Terminella et al. | 53/228 X |
| 4,759,281 | 7/1988 | Kasamatsu et al. | 100/295 |
| 4,805,373 | 2/1989 | Gaccetta et al. | 53/77 |

*Primary Examiner*—John Sipos
*Assistant Examiner*—Daniel Moon
*Attorney, Agent, or Firm*—Banner, Birch, McKie & Beckett

[57] ABSTRACT

A package wrapping apparatus and method compresses a package of napkins or a similarly soft bulked product during the wrapping operation to provide a tight wrapped package which does not become loose with settling. An air activated expandable elevator plate allows the bottom of the napkin package to be completely supported during the wrapping operation, and contracts to allow the plate to be lowered between front and rear underfolders. This allows the napkin stack to undergo a greater degree of compression without defects, since folding or curling of the napkin edges over the elevator plate is avoided. An air activated movable top compression plate applies variable downloading against the top of the package. As the elevator plate is raised, the package presses against the top compression plate and is thereby compressed. The top compression plate is then withdrawn to a position corresponding to the desired finished package height, and a sliding transfer operation of the package to a heat seal device is performed. This transfer operation is completed before the compressed package has recovered to the desired package height. In this manner, downward pressure on the package during the transfer operation is greatly reduced. As a result, the napkins and the wrap are much less likely to be displaced from their proper positions prior to the heat seal, and occurrences of defective packages are reduced. The air activated expandable elevator plate and top compression plate assemblies of the invention are simple in construction and may be readily retrofitted to existing wrapping machines.

40 Claims, 9 Drawing Sheets

COMPRESSION PACKAGE WRAPPING APPARATUS AND METHOD

BACKGROUND OF THE INVENTION

The present invention relates to the wrapping of packages with sheet material. More specifically, the invention relates to a method and apparatus for wrapping with sheet material a package lacking substantial rigidity, e.g., one or a bundle of textile or paper products. The invention finds particularly advantageous application to the wrapping of packages lacking substantial rigidity and which are readily compressible, e.g., a package of stacked of napkins.

A well known method of packaging napkins and similar products for retail sale is to wrap the product in protective sheet material such as polyethylene. With respect to napkins, typically such a packaging operation takes place as the final step in an automated assembly line operation involving initial napkin forming and stacking operations.

A desirable characteristic of most wrapped consumer packages, including packages of napkins, is that the product be tightly wrapped. A tight package wrapping provides a neat appearance with added consumer appeal, and assists in maintaining package integrity. A problem which frequently arises with wrapped packages of bulked product, e.g. napkins, is that the bulked product experiences a degree of settling between the time it is packaged and the time it is offered for sale to the consumer. Hence, a package which was initially tightly wrapped may become loose and sloppy in appearance by the time it reaches the retail sales shelf. To combat the tendency of napkin packages to become loose due to settling, it is desirable to compress the napkin package (one or more stacks of napkins) to a significant degree before it is wrapped. In this manner, the inherent elasticity of the bulked package presses the package tightly against the wrapping and further reduction of the height of the package is minimized.

Imparting compression to the product during the wrapping operation also advantageously produces a smaller finished package requiring less wrapping material and having reduced shipping costs.

A piece of equipment widely used for automated packaging of the type described above is manufactured and sold by Hayssen Manufacturing Co., of North Sheboygan, Wis., as the Model 5200 overwrap machine. The structure and sequential operation of this device is schematically illustrated in prior art FIGS. 13A–13G, and described in summary fashion below.

Referring to FIG. 13A, a package in-feed conveyer (not shown) has just delivered a "twin pack" of napkins 3 (two side-by-side stacks of napkins—only one is visible) to elevator mechanism 5. An elevator plate 7 of mechanism 5 reciprocates up and down, on an elevator shaft 8, in a synchronized manner under the control of a rotating cam 10. In the position shown, elevator plate 7 is positioned at the bottom of its stroke so that a napkin package 3 may be received thereabove on support rails 12 extending into elevator well 14. At this time, a piece of film 9 of the wrapping material, e.g., polyethylene, has been automatically cut from a parent roll (not shown) and positioned across elevator well 14 over the top of napkin package 3 by a belt conveyor (not shown).

Referring now to FIG. 13B, napkin package 3 is lifted by elevator mechanism 5 into contact with film 9 such that film 9 is wrapped around the top of the napkin package to drape over the front and rear (longitudinal) sides of the napkin package, and to protrude outwardly from the lateral sides. As seen in FIG. 13C, elevator plate 7 continues its upward movement pressing napkin package 3 against a spring loaded pressure plate 11 positioned at the desired package height. When elevator plate 7 reaches the top of its stroke as shown in FIG. 13C, napkin package 3 has been raised to a position above front and rear underfolders (bottom tucking blades) **13*a,b*. This allows the underfolders to move by cam action under the front and rear edges of napkin package 3 in order to fold or tuck front and rear film edge portions 9*a,b* underneath napkin package 3. Underfolders 13*a,b* also provide support for the napkin package when elevator plate 7 is lowered. At this point, package 3** has been compressed a certain amount.

FIG. 13C illustrates the tendency of the lower edges **3*a* of napkin package 3 to fold or cuff around elevator plate 7 during the compression. This occurs because elevator plate 7 is significantly narrower than the stacked napkins so that, as shown in FIG. 13D, elevator plate 7 may pass between underfolders 13*a,b* as elevator mechanism 5 is lowered. As a result, the degree to which pack 3 may be compressed during the packaging operation is significantly limited. If substantial compression is attempted, the resultant cuffed edges will be hit by tucking blades 13** as they move under the package. This results in defective finished packages having rolled over napkin edges inside.

After elevator plate 7 has been lowered below tucking blades 13, napkin package 3 remains supported at its edges by underfolder 13. Then, as shown in FIG. 13E, rear underfolder **13*b* moves further inward toward front underfolder 13*a*, tucking film 9 under the bottom of napkin package 3 and pressing rear film edge portion 9*b* flat against the bottom of the napkin package. Next, as shown in FIG. 13F, a transfer device 15 carrying spring loaded pressure plate 11 slides napkin package 3, with film 9 wrapped therearound, laterally to a bar-type heat sealer 17. This sliding movement brings front film edge 9*a* flat against the bottom of napkin package 3 in overlapping relation with edge portion 9*b*, and positions the overlapping portions 9*a,b* directly above heat sealer 17** for heat sealing therealong.

Omitted for clarity in FIGS. 13A–G are vertically oriented side folders (side tucking blades) which advance by cam action along the lateral sides of the napkin stacks slightly after rear underfolders **9*b* have begun to move for the second time. These side folders serve to fold or tuck in the rearward portions of firm 9** protruding from the lateral sides of the package. This constitutes the first step in a progressive side folding process described further below.

The machine cycle is completed by the return of transfer device 15, elevator plate 7 and underfolders 13 to their original positions as shown in FIG. 13G. In this position, elevator mechanism 5 is set to receive another napkin package from the package in-feed conveyor and a new piece of film 9 is advancing to a position over the elevator well. Although not illustrated, during the next cycle, the package just heat sealed in the previous cycle will be pushed by the transfer mechanism between a pair of side folding plates to complete the side folding process. These plates first tuck inwardly the frontward portion of film 9 protruding from the lateral sides of the napkin package, and then complete standard envelope folds on the lateral sides of the package. Thereafter, the package is advanced between a pair of heat sealing belts (not shown) where the envelope folds are heat sealed to produce a finished package.

Further details of the above-described prior art process and machine will be evident from the detailed description of the invention herein, wherein commonalities of the present invention and the prior art process and machine are identified.

The above-described prior art process and machine are capable of producing "twin pack" packages of napkins which are very popular with consumers. With this type of package configuration, the wrap is draped over the top face of two side-by-side napkin stacks (e.g., seventy napkins each) and a linear heat seal is provided across the bottom face of the stacks. Envelope folds are provided along two opposite napkin edge surfaces (the lateral package sides). While arrangements have been developed for providing high compression to stacked packages wrapped in a direction orthogonal to the stacking direction (see, e.g., U.S. Pat. No. 3,006,119 to Fingerhut), heretofore a satisfactory method and apparatus for wrapping stacked packages in the stacking direction (as in the above-mentioned "twin packs"), with an optimum amount of compression, has not existed.

The following U.S. patents disclose other packaging methods and apparatus operative to wrap a stacked package in the stacking direction.

James et al. U.S. Pat. No. 4,279,116 and Coates U.S. Pat. No. 3,212,230 each disclose wrapping apparatus which utilize complex linkages and cam-actuation to expand and contract an elevator plate so that the entire package to be wrapped is supported during the wrapping operation. In each device, the elevator plate can be contracted to allow underfolders to engage and fold wrapping material under the package. While these patents address the problem of wrapping defects resulting from curled or folded edges of the product, they do not address the need to provide significant compression to a soft bulked product during the wrapping operation to achieve a tight package.

It is also significant that the complex cam-actuated expandable elevator mechanisms of these patents would not be easily adaptable to retrofit existing apparatus, such as the Hayssen Model 5200 wrapper.

Gordon U.S. Pat. No. 3,861,120 discloses a wrapping apparatus for wrapping a stack of napkins, having an air cylinder actuated upper gripping member serving to compress the napkin stack as it is raised by an elevator. The gripping member also serves to move the package first in one horizontal direction and then in a reverse direction to effect underfolding of the wrapper about the package, without the requirement of retractable underfolders. Without retractable underfolders, this apparatus is able to employ an elevator plate corresponding in size to the napkin stack. While this arrangement addresses the problem of wrapping defects due to sagging package edges, the need to move the package in two horizontal directions across the elevator plate to form the underfolds has apparent disadvantages. For example, the reversal of motion of the package would create a greater likelihood that the wrap will become displaced on the package, resulting in defective folds. Secondly, the machine operation would be made more violent by the added motion reversal, leading to increased machine break-down and required maintenance. Also, each additional machine stroke required for the packaging operation increases cycle times and lowers production efficiency.

It is also significant that the Gordon apparatus is complex and would not be easily adaptable to existing apparatus such as the Hayssen Model 5200 wrapper.

SUMMARY OF THE INVENTION

In view of the above, it is an object of the invention to provide an improved package wrapping apparatus which can impart to a soft compressible package to be wrapped a high degree of compression to obtain a tight package that will not subsequently become loose due to settling.

Another object of the invention is to provide a packaging method and apparatus which avoid the occurrence of defective packages due to rolled or folded edges.

A further object of the invention is to provide an apparatus which is simple to retrofit to improve existing machines, such as the Hayssen Model 5200 wrapper.

Yet another object of the invention is to provide an automated package wrapping apparatus which is simple and inexpensive in construction and reliable and efficient in operation.

Still another object of the invention is to produce wrapped packages of reduced size requiring less wrapping material and having lower shipping and storage costs.

The above and other objects are achieved in accordance with the present invention which, in one aspect, provides an improved package wrapping apparatus. The apparatus has a reciprocating elevator mechanism operative to move a package to be wrapped upwardly along a first path of the apparatus. Sheet feeding means are provided for feeding a piece of wrapping material across the first path such that the package is draped with the wrapping material as it is moved therealong.

A top compression plate assembly is provided, and comprises a compression plate located above the elevator mechanism, operative to compress the package after it has been draped with the wrapping material, and as the package is moved upwardly by the elevator mechanism; and actuating means for moving the compression plate between a first lowered compressing position and a second elevated position.

A folding mechanism is provided for folding the draped wrapping material against the package after it has been compressed. The folding mechanism comprises a pair of underfolding blades operative to move under opposite package edges once the elevator mechanism has moved the package thereabove. The elevator mechanism comprises an expandable elevator plate assembly providing a package support surface which is expandable for supporting the package during package compression, and contractable for allowing the elevator plate assembly to avoid interference with the underfolding blades near the top of its stroke.

In other aspects, the invention provides an expandable elevator plate assembly for a package wrapping apparatus, a kit of parts for retrofitting existing apparatus, and a novel package wrapping method. These and other aspects and features will be apparent from the following detailed description of the invention, taken in connection with the appended drawings.

DETAILED DESCRIPTION OF THE PREFERRED EMBODIMENTS

The preferred embodiment of the invention constitutes an improvement on the prior art Hayssen Model 5200 wrapper (and the associated conventional package wrapping process) described in the background section of this application. The structure of the inventive apparatus differs from the prior art Hayssen wrapper in the following principal respects. First, in place of the conventional fixed dimension elevator plate 7 is provided an air-actuated expandable elevator plate 101. Secondly, in place of the conventional spring biased pressure plate 11 is provided a vertically reciprocable air cylinder actuated compression plate assembly 103. These and other related structural and operational differences will be apparent from the following description.

The primary components and sequential operation of the inventive apparatus are initially described with reference to FIGS. 1A–1G and 2. It should be understood that the particular napkin package wrapping operation described herein is illustrative rather than limiting with respect to the types of packages that can be wrapped with the inventive process and apparatus.

Figure 1A:
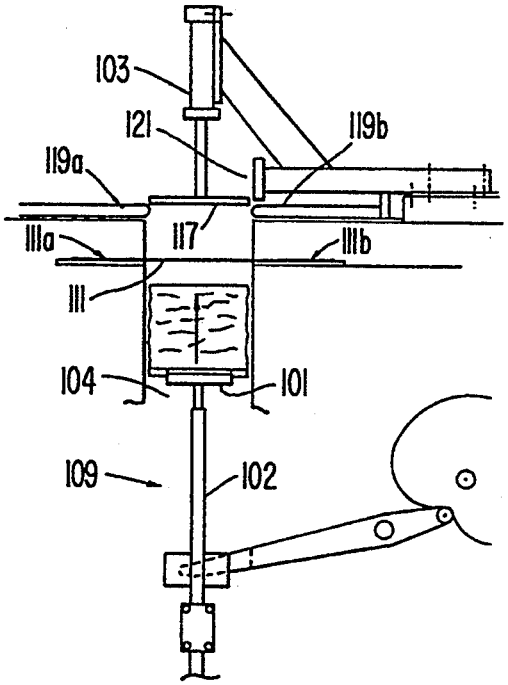
FIGS. 1A–1G are schematic side views illustrating the sequential operation of the present inventive process and apparatus.

Referring first to FIG. 1A, the inventive apparatus comprises a package infeed conveyor 105 (see FIG. 2) which delivers a package to be wrapped, e.g., a "twin pack" of napkins 107, to a cam driven elevator mechanism 109. Expandable elevator plate 101 thereof is mounted on top of an elevator shaft 102 for reciprocating motion within an elevator well 104. At the point shown in FIG. 1A, expandable elevator plate 101 is at the bottom of its stroke and is in its expanded condition. In its expanded condition, elevator plate 101 extends laterally to support the entire undersurface of napkin package 107.

Figure 1B:
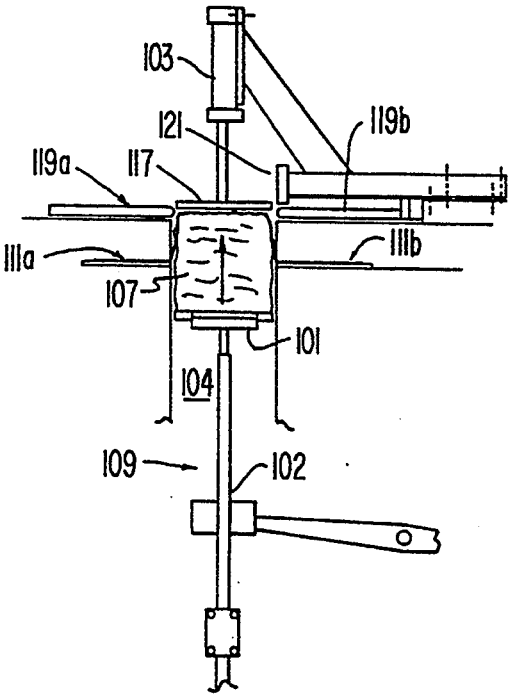

Elevator mechanism 109 elevates napkin package 107, positioned on plate 101, into wrapping contact with a piece of wrapping film 111, e.g., polyethylene, extending across elevator well 104, as seen in FIG. 1B. Film 111 is cut from a parent roll (not shown) by a cutting roll 113 (see FIG. 2), and is positioned over napkin package 107 (rising on elevator plate 101) by parallel belt conveyors 115 (see FIG. 2).

As seen in FIG. 1B, the top surface of napkin package 107 is about to make contact with a top compression plate 117 of top compression plate assembly 103. At this point, top compression plate 117 is at the bottom of its stroke, and has positioned compression plate 117 just slightly (e.g., ⅛") above the plane of motion of front and rear package underfolders 119*a*, 119*b*.

Figure 1C:
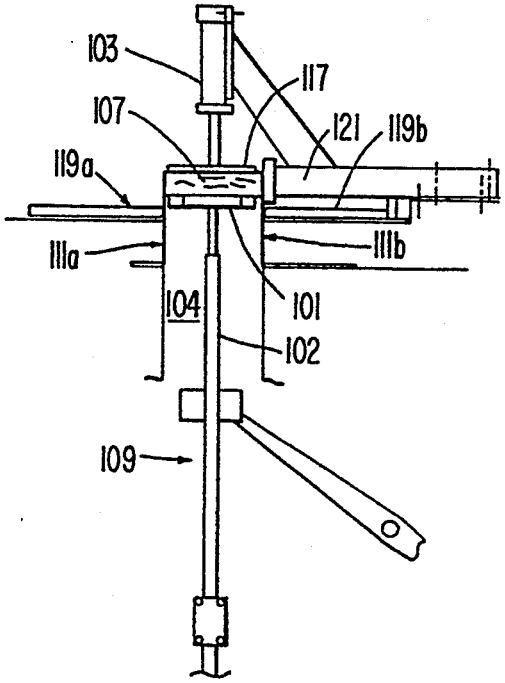
Figure 13A:
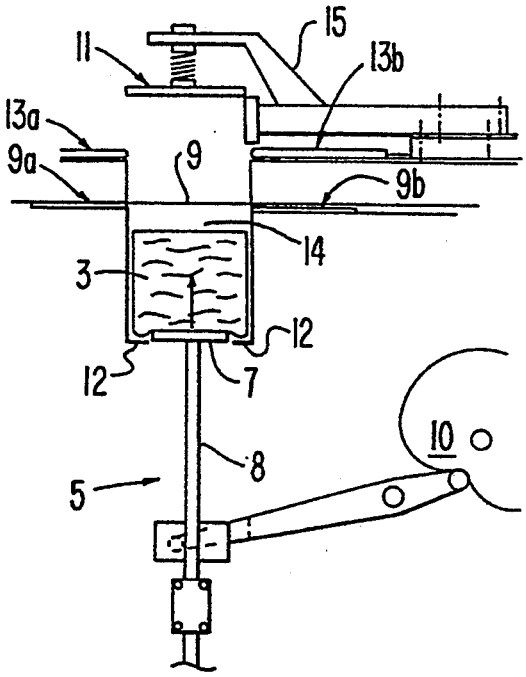
FIG. 13A PRIOR ART
FIGS. 13A–13G are schematic side views illustrating the sequential operation of a prior art package wrapping process and apparatus.
Figure 13B:
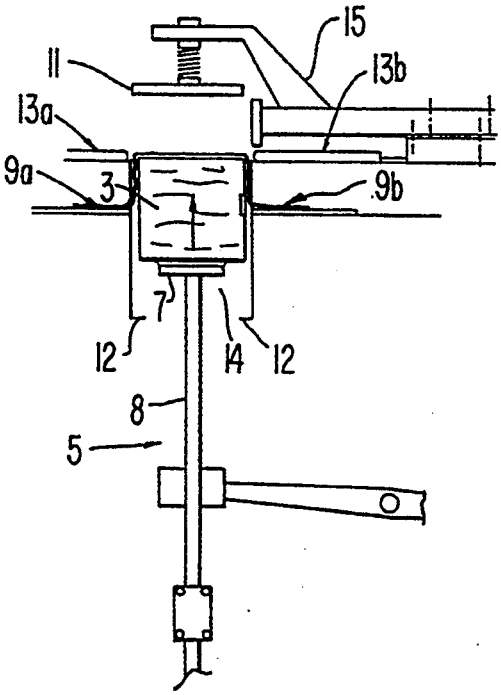
FIG. 13B PRIOR ART
Figure 13C:
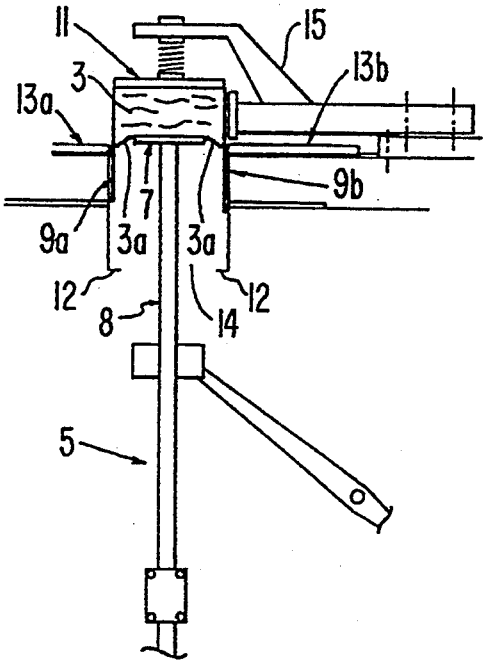
FIG. 13C PRIOR ART
Figure 13D:
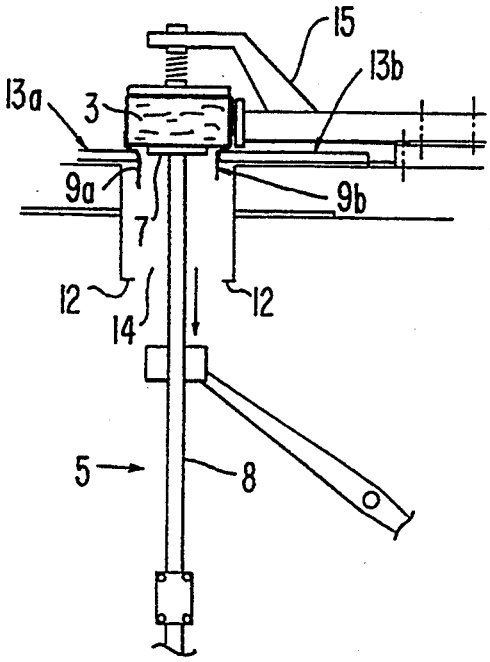
FIG. 13D PRIOR ART
Figure 13E:
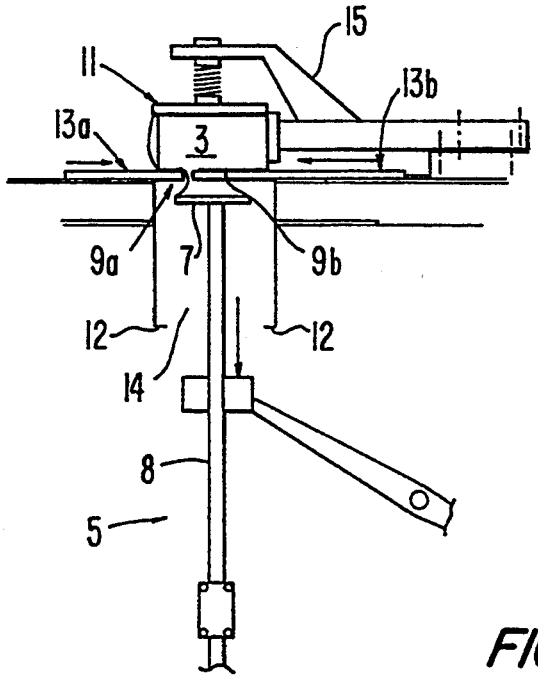
FIG. 13E PRIOR ART
Figure 13F:
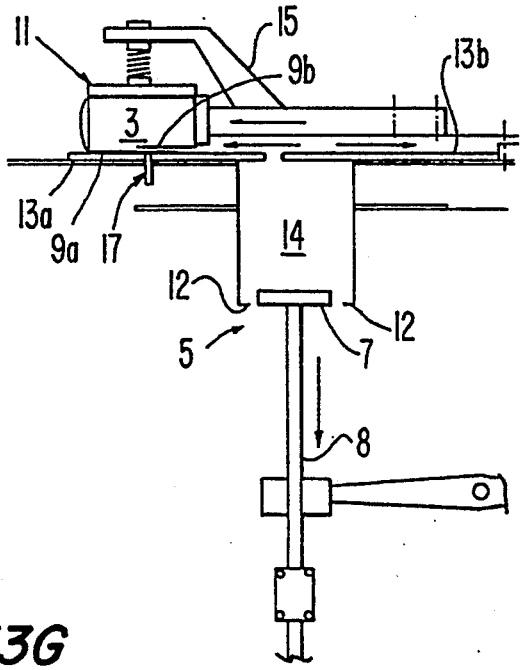
FIG. 13F PRIOR ART
Figure 13G:
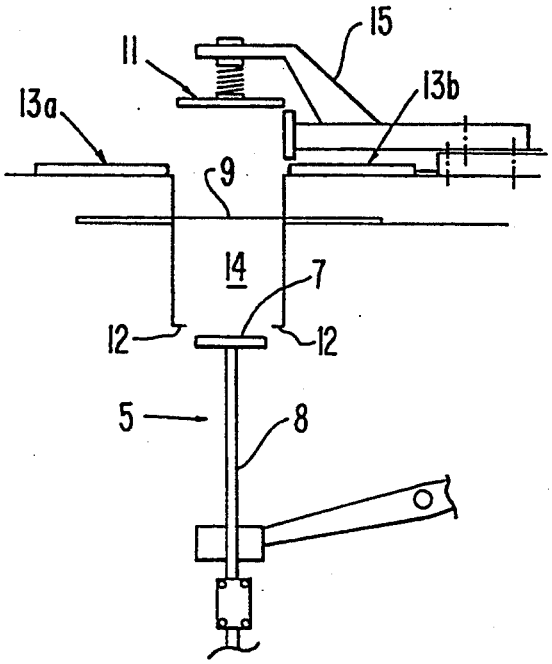
FIG. 13G PRIOR ART

As seen in FIG. 1C, elevator plate 101, still in its expanded condition, continues its upward movement and compresses napkin package 107 against compression plate 117 until elevator plate 101 reaches the top of its stroke. At this point, elevator plate 101 has raised napkin package 107 to a position slightly (e.g., ¾") above front and rear underfolders 119*a,b*. Since the bottom of napkin package 107 is completely supported by elevator plate 101, a high degree of compression can be achieved without the problem of folded or curled package edges (compare prior art FIG. 13*c*). As a result, very fight packages can be produced with a low defect rate.

Figure 1D:
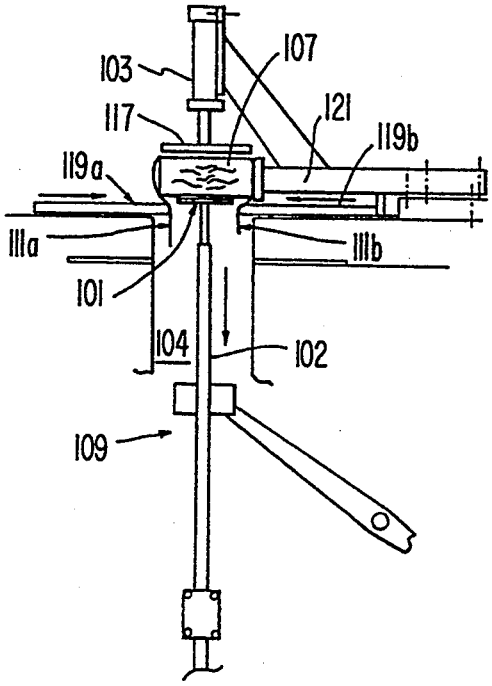

Just after elevator plate 101 has reached the top of its stroke and started back down, the longitudinal sides of elevator plate 101 quickly retract (in a manner to be described in detail hereinafter) so that elevator plate 101 has a width equal to that of the narrow prior art Hayssen plate. Then, as shown in FIG. 1D, underfolders 119*a,b* move just under the edges of napkin package 107. This tucks front and rear film edge portions 111*a,b* underneath napkin package 107, and provides support for the package when elevator plate 101 is lowered. The contraction of elevator plate 101 allows it to pass downwardly between underfolders 119, just before rear underfolder 119*b* makes a second move further inward toward underfolder 119*a* as described below.

Just prior to the point at which elevator plate 101 contracts (ideally, with an advance of 1–2 degrees of camshaft rotation), top compression plate 117 quickly retracts to its upper position corresponding to the desired finished package height. Since napkin package 107 does not immediately recover to this height, compression plate 117 temporarily is removed from contact with the top of the napkin package. This advantageously relieves downward pressure on napkin package 107 to facilitate a subsequent transfer operation, as will be described.

Figure 1E:
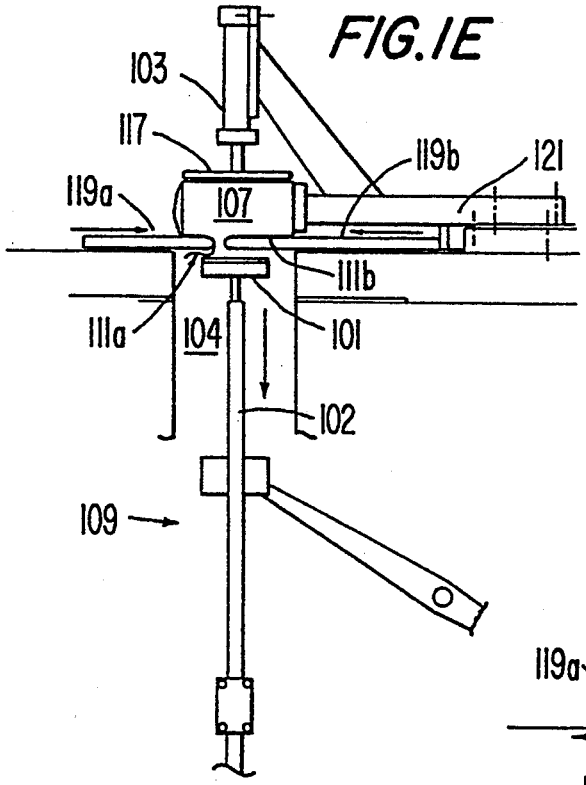

Just after elevator plate 101 has been lowered below underfolders 119*a,b*, as shown in FIG. 1E, rear underfolder 119*b* moves further inward toward front underfolder 119*a*, tucking film 111 under the bottom of napkin package 107 and holding rear film edge portion 111*b* flat against the bottom of the napkin package. During this motion of rear underfolder 119*b*, elevator plate 101 will dwell momentarily at a point just below underfolders 119 in order to provide support to the center of the package.

Figure 1F:
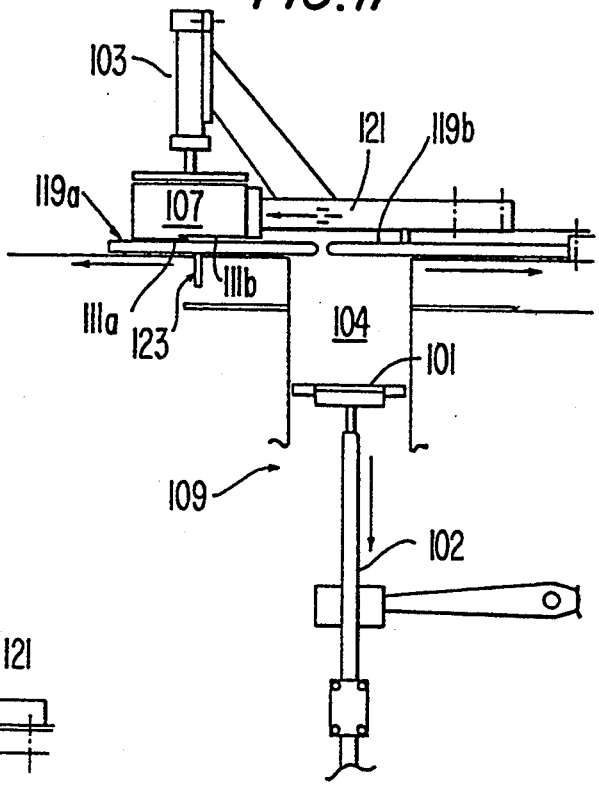

Next, as shown in FIG. 1F, a carriage-type package transfer device 121 carrying top compression plate assembly 103 slides napkin package 107, with film 9 wrapped therearound, laterally to a bar-type heat sealer 123. This sliding movement brings front film edge 111*a* flat against the bottom of napkin package 107 in overlapping relation with edge portion 111*b*, and positions the overlapping portions 111*a,b* directly above heat seal device 123 for heat sealing therealong. As noted previously, prior to this transfer operation, napkin package 107 has been compressed to a reduced size, and then substantially relieved of downward pressure by the retraction of compression plate 117 to the desired package height. Advantageously, the transfer operation is completed before napkin package 107 has had a chance to recover fully to the desired package height, so that package 107 is substantially relieved of downward pressure during the transfer operation. This significantly reduces the tendency of the package edges and wrapping material to roll over or become otherwise improperly displaced during the transfer operation. As a result, occurrences of defective packages are significantly reduced.

Vertically oriented cam-actuated side tucking blades 124 (see FIG. 2) advance along the lateral sides of the napkin package just slightly after rear underfolder 119*b* has begun to move for the second time. Side tucking blades 124 serve to fold or tuck in the rearward portions of film 111 protruding from the lateral sides of the napkin package. This constitutes the first step in a progressive side folding process described further below.

Figure 1G:
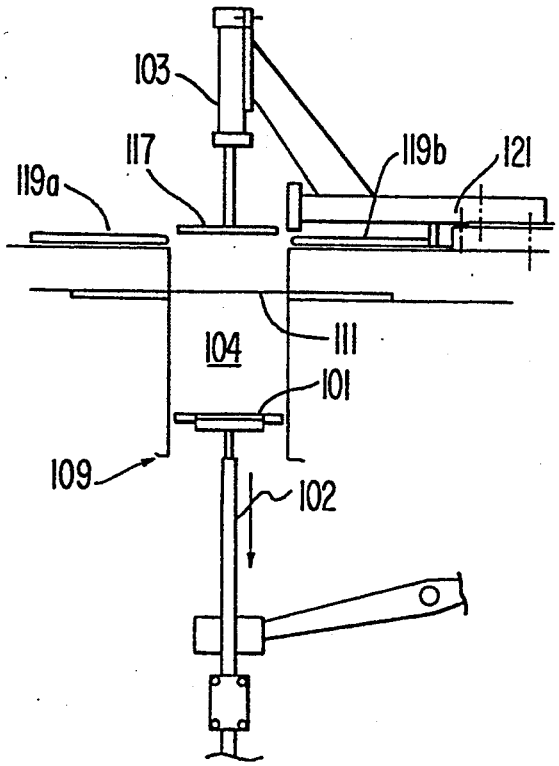

The machine cycle is completed by the return of transfer device 121, top compression plate 117, underfolders 119 and elevator plate 101 to their original positions as shown in FIG. 1G. In its original position, elevator plate 101 is expanded and set to receive another napkin package from package in-feed conveyor 105. This expansion can be set to occur at any point after elevator plate 101 has dropped below underfolders 119.

In the inventive apparatus, the package support rails 8 of the prior art Hayssen elevator mechanism 5 are omitted to accommodate expanded elevator plate 101 in elevator well 104, at the point where plate 101 reaches the bottom of its stroke. As a further modification, the elevator well may be provided with extended wall portions 125 extending a short distance below conveyor 105, in order to keep packages in proper alignment should they have to fall a short distance from in-feed conveyor 105 to elevator plate 101.

During the next cycle, the napkin package just heat sealed in the previous cycle will be pushed by transfer mechanism 121 between a pair of stationary side folding plates 127 (see FIG. 2) to complete the side folding process. The upstream ends of plates 127 first tuck inwardly the frontward portion of film 111 protruding from the lateral sides of the napkin package, and then forming slots 128 (see FIG. 11) of plates 127 complete standard envelope folds on the lateral sides of the package. Thereafter, the package is advanced between a pair of heat sealing Teflon belts 129 (see FIG. 2) where the envelope folds are heat sealed to complete a finished package.

Figure 2:
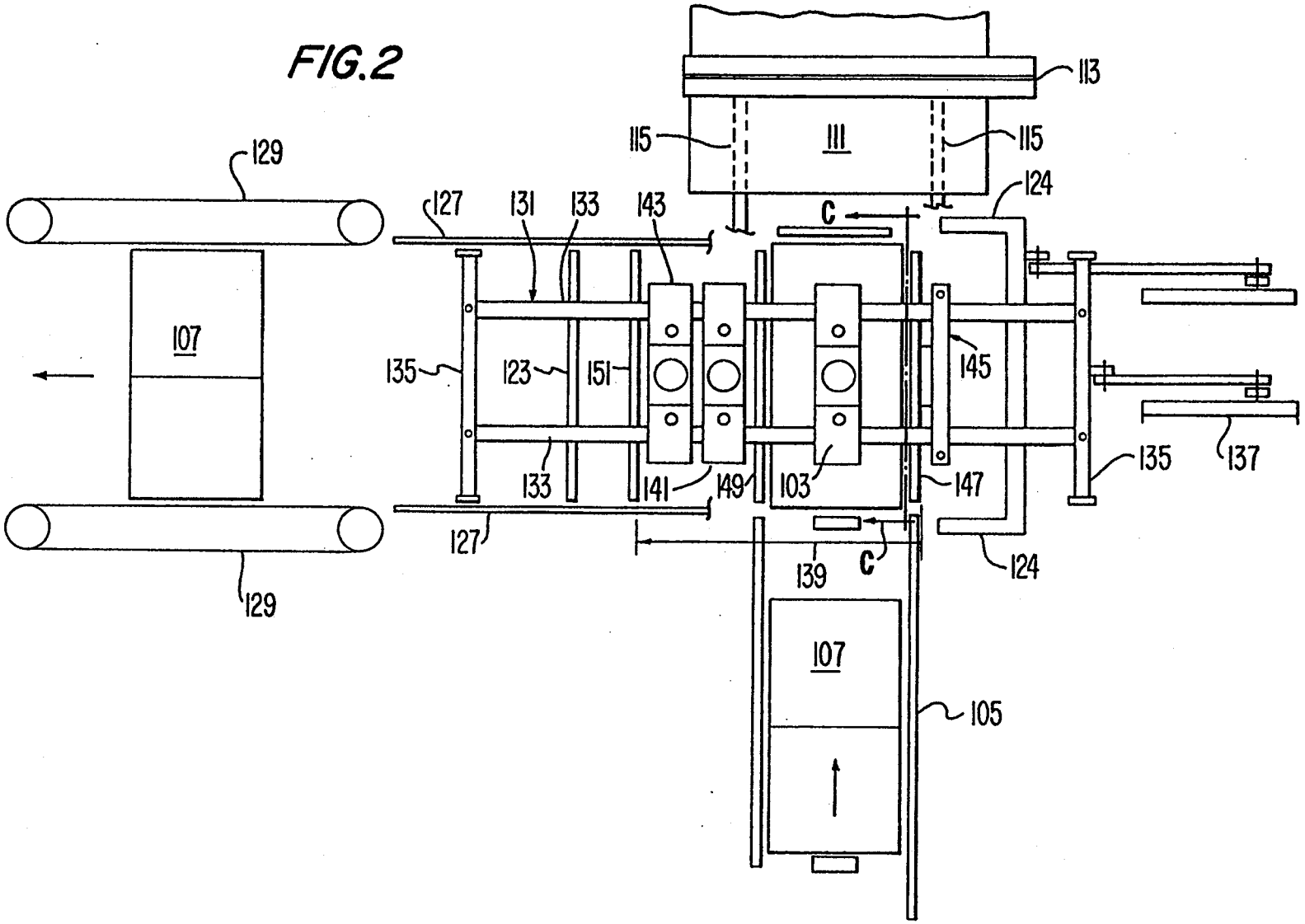
FIG. 2 is a schematic top plan view of a wrapping apparatus in accordance with the present invention.
Figure 3:
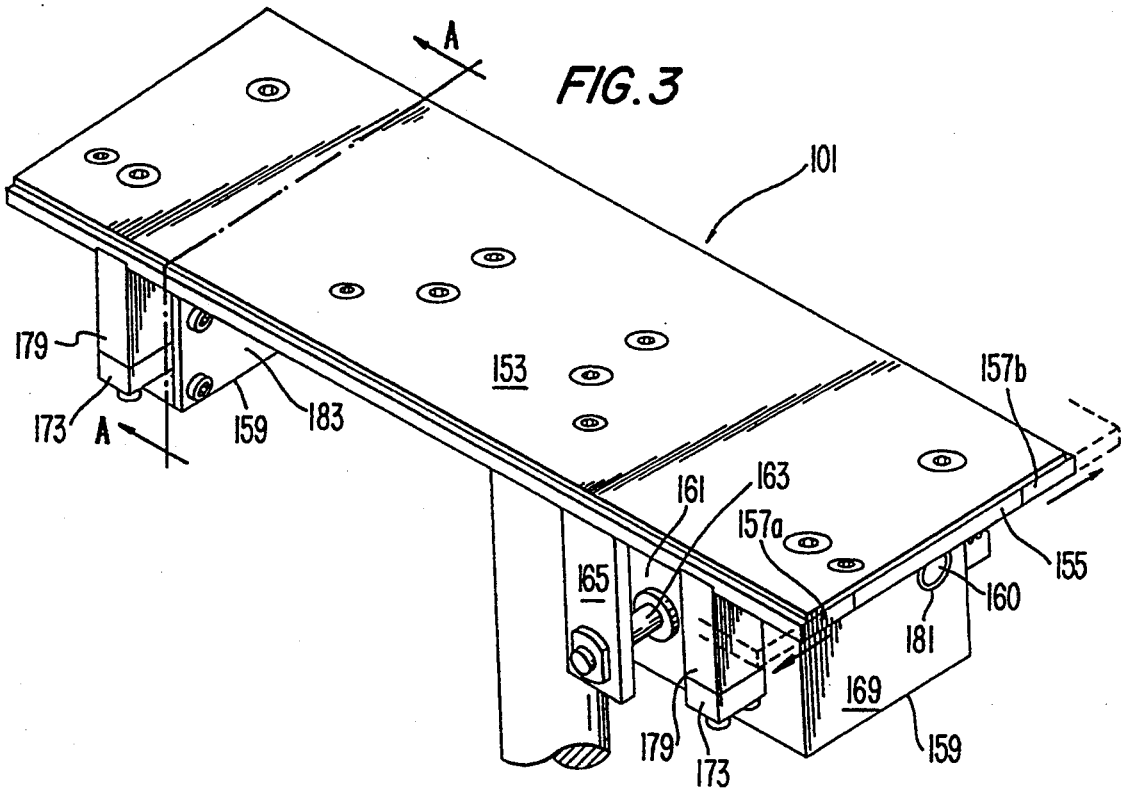
FIG. 3 is a perspective view of the top side of an expandable elevator plate in accordance with the present invention.

Transfer mechanism 121 is now described in greater detail. Referring to FIG. 2, transfer mechanism 121 can be seen to comprise a carriage 131 comprising two round shafts 133 running longitudinal with the transfer direction of the napkin packages 107, and front and rear transverse plates 135 rigidly connecting the ends of shafts 133. Carriage 131 is mounted for timed reciprocating movement under the control of a cam 137. During a machine cycle, carriage 131 makes the stroke depicted by arrow 139 and returns to its original position.

Mounted on parallel shafts 133 for reciprocation with carriage 131 is the top compression plate assembly 103. Similarly mounted to carriage 131 are vertically reciprocable air cylinder actuated plate assemblies 141 and 143. Finally, carriage 131 carries with it a fixed pusher plate assembly 145. Excepting the substitution of compression plate assembly 103 for spring loaded pressure plate 11, this structure essentially corresponds to that of the Hayssen prior art transfer mechanism 15.

Pusher plate assembly 145 includes a pusher plate 147 serving to push packages from above elevator well 104 to heat sealer 123. Plate assembly 141 includes a plate 149 which, together with pusher plate 147, boxes-in a package being wrapped in order to keep it properly aligned as it is pushed by pusher plate 147. Plate 149 is made vertically reciprocable so that it can pass over a transferred package on the return stroke of carriage 131. Finally, plate assembly 143 includes a pusher plate 151 serving to push a package just heat sealed at heat sealer 123 on through stationary folding plates 127 (during the next machine cycle). Pusher plate 151 is, similar to plate 149, made vertically reciprocable. This allow pusher plate 151 to pass, on the return stroke of carriage 131, over a package which has just been transferred to heat sealer 123.

The structure and operation of expandable elevator plate 101 are now described in detail with reference to FIGS. 3–7.

Elevator plate 101 comprises a thin top surface plate 153, e.g., 1/16" thick, secured to a narrower underlying mounting plate 155 in such a manner that the opposite longitudinal sides of surface plate 153 overhang the corresponding sides of plate 155 by a predetermined amount. Movable underneath and out from under the overhanging portions of surface plate 153 are extension wing members 157*a,b*. Wing members 157 extend the length of plates 153 and 155. The combined width of wing members 157*a,b* and mounting plate 155 should be approximately equal to the width of surface plate 153, so that in the contracted condition of elevator plate 117 (depicted in solid lines in FIG. 3), wing members 157 fit substantially beneath the overhanging portions of surface plate 153.

Surface plate 153 is preferably stainless steel, which is relatively stiff and will not mark the packages being wrapped. Mounting plate 155 is preferably aluminum, which possesses adequate strength characteristics yet is relatively lightweight. In this regard, it should be noted that it is important to keep the mass of elevator plate 101 as low as possible in order to reduce violent action at the top and bottom of the elevator stroke.

Hardened steel has been found to be the most suitable material for wing members 157. The added strength of steel over aluminum is generally necessary to withstand inadvertent impacts of the wing members with other machine parts, as can occur during machine adjustment and operation.

The length of elevator plate 101 should equal that of the package being wrapped, e.g., napkin package 107.

In its contracted condition, elevator plate 101 should have a width just small enough to pass freely between front and rear underfolders 119*a,b* after they have moved in underneath the edges of package 107, as shown in FIG. 1D. In its expanded position (shown in dotted lines in FIGS. 3 and 4), elevator plate 101 should have a width equal to that of package 107, in order to provide support to the entire undersurface of package 107 during the compression operation.

Figure 5:
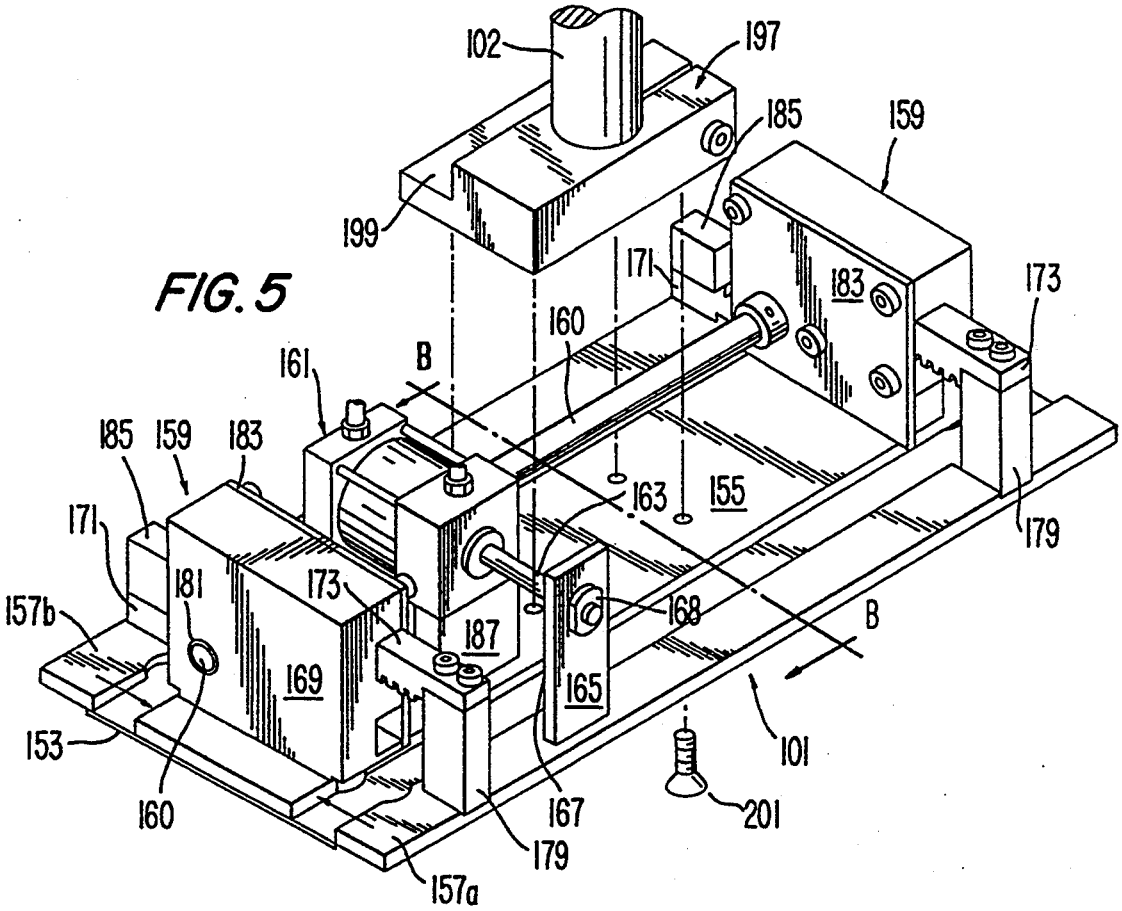
FIG. 5 is a partially exploded perspective view of the bottom side of the expandable elevator plate of FIG. 4.
Figure 6:
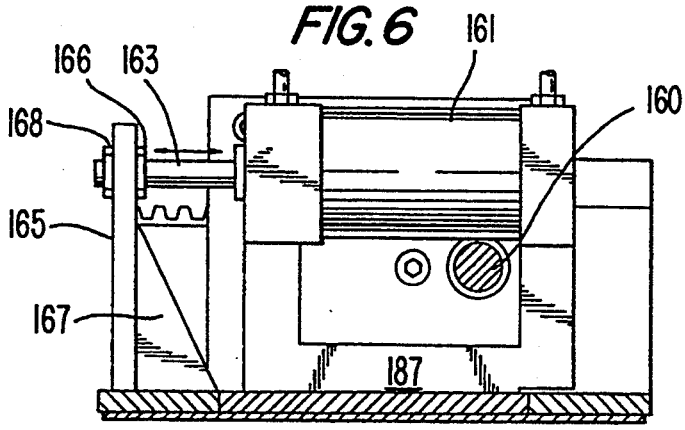
FIG. 6 is a transverse cross-sectional view taken on line B—B in FIG. 5, illustrating the mounting of an elevator plate actuating air cylinder, and showing the elevator plate in its contracted position.

Referring specifically to FIG. 5, it can be seen that a number of components are mounted to the undersurface of mounting plate 155. Extension wings 157 are attached to mounting plate 155 through identical rack gear assemblies 159 positioned at opposite ends of elevator plate 101. Rack gear assemblies 159 translate the motion of one wing member 157 into an identical opposing motion of the other wing member 157. As a result, if wing member 157*a* is moved outwardly to its extended position, wing member 157*b* is likewise caused to move outwardly to its extended position.

The two spaced rack gear assemblies 159 are linked by a torque rod 160 which transmits the motion of one assembly to the other in a manner to be described hereinafter. This arrangement of two spaced rack gear assemblies is preferable over a single central rack gear when the elevator plate has substantial length, to provide increased rigidity and strength to the elevator plate, and to ensure equal movement of the opposite ends thereof. Obviously, additional or fewer rack gear assemblies 159 may be utilized depending on the size of the elevator plate.

The movement of wing members 157 is actuated by a dual action reciprocating air cylinder 161. Air cylinder 161 is mounted to mounting plate 155 and has its piston rod 163 attached to wing member 157*a* through a bracket 165.

The connection between rod 163 and bracket 165 is made with a two piece flexible mount. A metal sleeve having a ranged end 166 (see FIG. 6) is positioned on rod 163, and inserted into an oversized bore in bracket 165. A nut 168 is then threaded onto rod 163 into contact with file end of the sleeve protruding slightly from the outside of bracket 165. Thereby, bracket 165 is flexibly retained between ranged end 166 and nut 168 such that slight mis-alignments will not impede proper operation of air cylinder 161.

Bracket 165 will be subjected to severe stresses in operation due to the rapid reciprocating movement that it must transmit. Accordingly, it is preferable to form bracket 165 of hardened steel, and to weldaby secure it to wing member 157. For the same reason, bracket 165 is provided with a strength reinforcing gusset 167.

Figure 4:
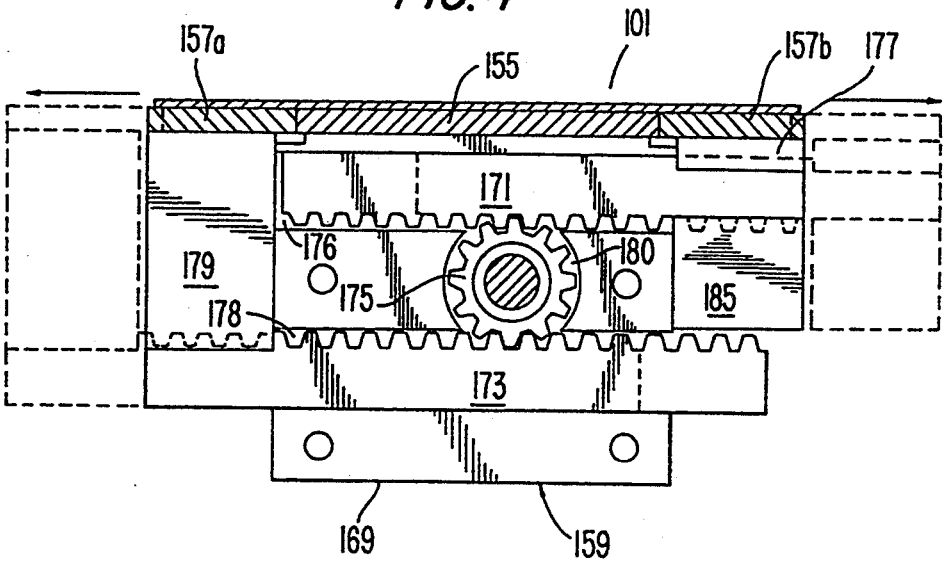
FIG. 4 is a transverse cross-sectional view taken on line A—A in FIG. 3, illustrating a rack gear assembly of the expandable elevator plate.

The components of rack gear assemblies 159 are clearly visible in FIG. 4. They comprise a housing block 169, an upper rack gear 171, a lower rack gear 173 and a pinion gear 175. Upper rack gear 171 is slidable within an upper channel 176 defined in housing block 169, and is secured, preferably by allen cap screws and welding, to wing member 157*b* through a relatively short spacer block 177. Lower rack gear 173 is similarly slidable in a lower channel 178 defined in housing block 169, and attached to wing member 157*a* through a longer spacer block 179. Pinion gear 175 is mounted on torque shaft 160 within a circular housing cavity 180. In turn, torque shaft 160 is journaled for rotation to each housing block 169 through respective bronze bushings 181 (see FIGS. 3 and 5).

Housing block 169 is preferably machined from a block of high performance engineering grade plastic material, e.g., high density polyurethane, and is covered with a steel plate 183. High density polyurethane exhibits the required strength characteristics, is light-weight, and can accommodate the sliding action of the rack gears with minimal friction and wear.

Attached to the undersurface of each upper rack gear 171, opposite spacer block 177, is an aluminum block 185. Block 185 performs a function inherently performed by longer spacer block 179. Namely, spacer block 179 and block 185 are positioned to act as impact surfaces should underfolders 119 inadvertently close while elevator plate 101 is still thereabove. If this happens, the force from the impacting underfolder will be transmitted to the corresponding wing member(s) through one or both of spacer block 179 and block 185. In turn, this will cause wing members 157 to retract so that elevator plate 101 can pass between underfolders 119. In this manner, machine shut down and damage are avoided.

Air cylinder 161 may be of standard design, but should have a stroke length suitable for providing the required extension of wing members 157. A suitable air cylinder for the exemplary napkin package wrapping operation described herein is the Tom Thumb model manufactured by PHD Factory Automation of Fort Wayne, Ind. (1" diameter and stroke; modified from clevis to foot mount and to have $\frac{7}{8}$" stroke). As may be seen clearly in FIG. 6, air cylinder 161 is mounted to mounting plate 155 through a U-shaped block 187. This arrangement provides the necessary clearance for torque shaft 160 to pass between rack gear assemblies 159. Preferably, block 187 is a single piece of machined aluminum, and is held sandwiched between air cylinder 161 and mounting plate 155 by allen cap screws passing therethrough.

Figure 7:
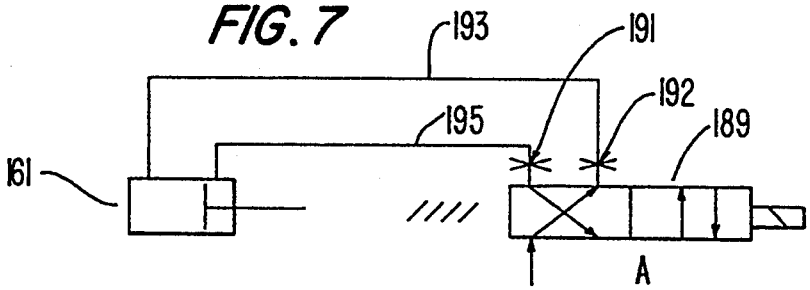
FIG. 7 is a schematic diagram illustrating the air flow control circuit of the elevator plate actuating air-cylinder.

The control of air cylinder 161, and hence the opening and closing of elevator plate 101, is now described with reference to FIG. 7. The air flow to and from air cylinder 161 is controlled by a standard four way—two position solenoid operated spring return valve 189. Valve 189 is operated in timed relation with the rotation of a camshaft of the wrapping machine, by a programmable controller or other known switching arrangement. Adjustable flow controllers are placed in the connecting lines 193 and 195, preferably set to control the flow of air from the cylinder. Generally, flow controller 191 should be set wide open to provide maximum closing speed of elevator plate 101, since the speed and timing of this closing action is critical. On the other hand, the timing and speed of the opening of elevator plate 101 is not so critical. Accordingly, flow controller 192 may be set to restrict the air flow in line 193, in order to slow the opening speed of elevator plate 101 and thereby provide smoother machine operation. Ideally, the air supplied to air cylinder 161 should be maintained at 30 psi or slightly below.

Other suitable valve arrangements may be utilized, as known in the art. For example, for added safety, or where required by local regulations, a three position double solenoid valve with spring return to exhaust may be employed in place of two position valve 189.

Elevator plate 101 is mounted to elevator shaft 102 through a split block 197. Block 197 has a recessed surface 199 for accommodating torque shaft 160, and is mounted to elevator plate 101 by flat head bolts 201. Block 101 is preferably made of steel rather than aluminum due to the high stresses encountered at the mounting point.

As a conventional safety feature, elevator shaft 102 is linked to the operating cam through a ball detent kick-out joint (not shown). The kick-out joint releases in case elevator plate 101 or shaft 102 becomes jammed during operation. In this regard, it should be noted that due to the higher mass of elevator plate 101, as compared with plate 7 of the Hayssen prior art machine, it is necessary to adjust upwardly the release force of the kick-out joint from that which would otherwise be required, in order to avoid premature release.

Figure 8:
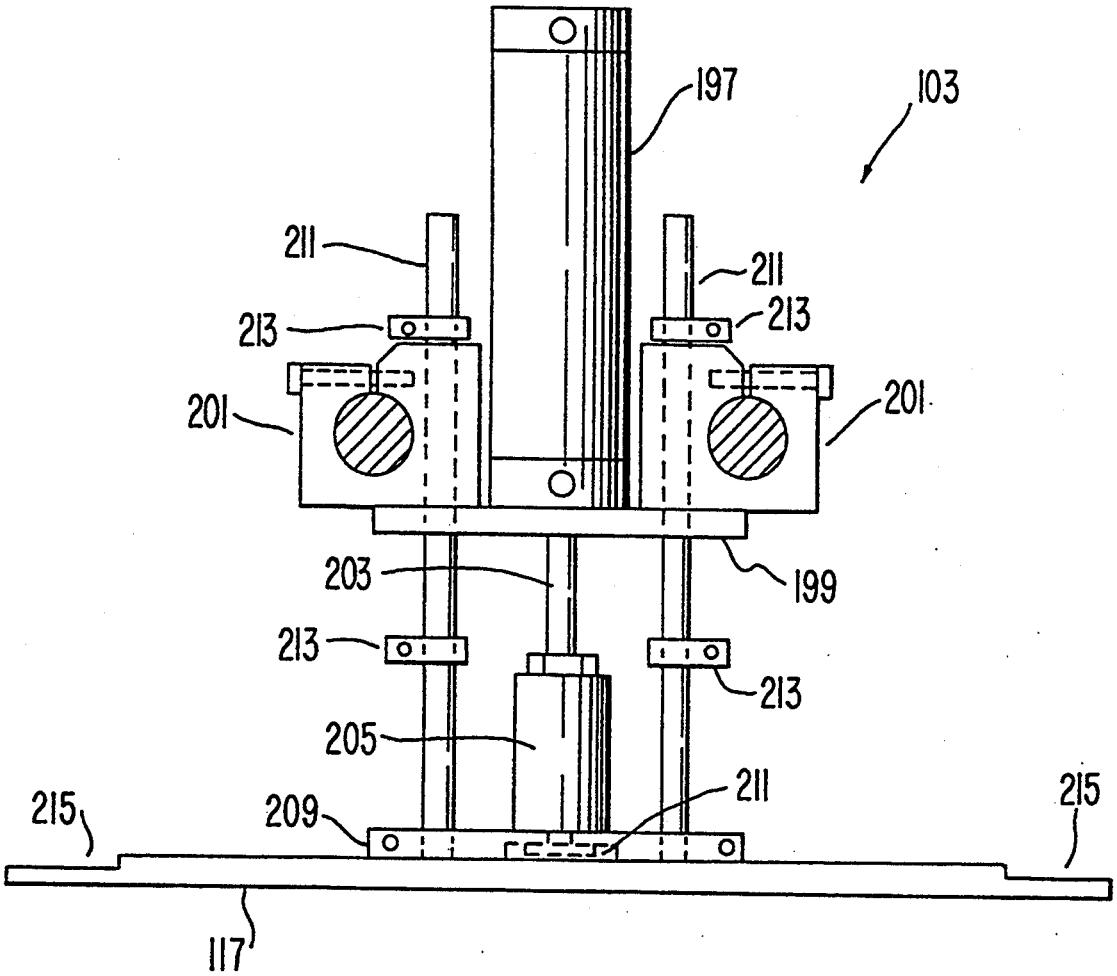
FIG. 8 is transverse cross-sectional view taken on line C—C in FIG. 2, illustrating a top compression plate assembly in accordance with the present invention.

Top compression plate assembly 103 is now described in detail with reference to FIG. 8.

Top compression plate assembly 103 mounts top compression plate 117 for transverse movement with carriage 131, and vertical movement actuated by a dual action air cylinder 197. Dual action air cylinder 197 is supported at its lower end on a horizontal support plate 199. A suitable type of air cylinder 197 is a Bimba, model 175 DP, having a 1½" diameter and a stroke length of 5". This type of air cylinder has a threaded end which may be directly threadably engaged with support plate 199.

Support plate 199 is secured at its opposite ends to split mounting blocks 201 which are clamped onto parallel shafts 133 of carriage 131. Piston rod 203 of air cylinder 197 is secured at its lower end to a metal spacer block 205. Spacer block 205 is connected to top compression plate 117 through a clamping block 209. Also attached to compression plate 207 through clamping block 209 are hardened steel guide rods 211 which extend through and are movable within support plate 199 and mounting blocks 201.

Guide rods 211 serve to smoothly guide compression plate 117 up and down with reciprocating piston rod 203, and lend rigidity to the assembly. Mounted on hardened guide rods 211 are four motion limiting clamps 213 which allow precise adjustment of the top and bottom positions of plate 117. Roller bushings (not shown) are provided in mounting blocks 201 to reduce friction and ensure smooth up and down movement of plate 207.

Spacer block 205 serves two primal), purposes. First, it allows air cylinder 197 to be placed up high in the machine away from the working parts. Secondly, spacer block 205 provides a flexible mount 211 with clamping block 209 to prevent binding due to slight mis-alignments.

Top compression plate 117 is generally similar to plate 11 of the Hayssen prior art machine, but differs in the following significant respects.

The original Hayssen plate 11 is sized about 1½" shorter than the length of the napkin package (end to end), in order to fit between two ¾" wide upper package guide rails provided along the respective upper edges of the original stationary side folding plates. With the compression achieved by movable top compression plate 117, this arrangement was found to be less than ideal. During package compression, the lateral edges of the packages tended to cuff around the ends of the elevator plate (a problem similar to that which is solved with expandable elevator plate 101) with the result that some finished packages were being produced with rolled or folded lateral edges. In order to solve this problem, the following modifications are implemented.

Elevator plate 101 is sized to cover the entire upper surface of the package to be wrapped, i.e., is made the same size as elevator plate 101 (in its expanded position) and 1½" inches longer than the original Hayssen plate 11. So as to accommodate elevator plate 101 between the stationary side folding plates, the following additional modifications are made.

First, the two ¾" extended end portions 215 of plate 117 are milled down ⅛" (leaving a thickness of ⅛"). Next, the stationary side folding plates are modified to the configuration of plates 127 as shown in FIGS. 10–12.

Figure 10:
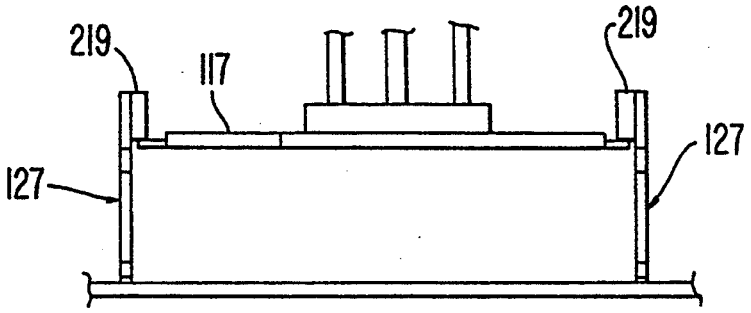
FIG. 10 is an end view of a side folding plate assembly in accordance with the present invention, showing the relation of the side folding plate assembly to the top compression plate.
Figure 11:
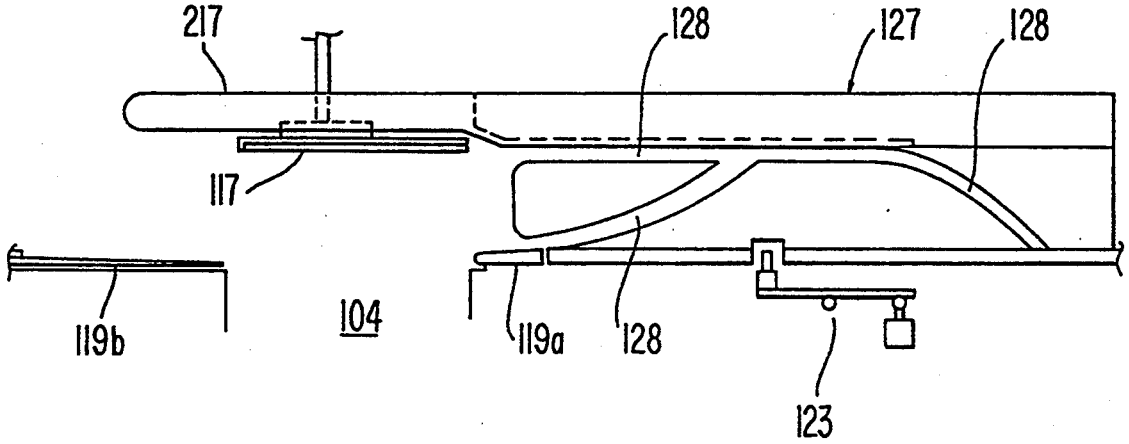
FIG. 11 is a side view of the side folding plate assembly shown in FIG. 10, depicting also adjacent structure of the apparatus.
Figure 12:
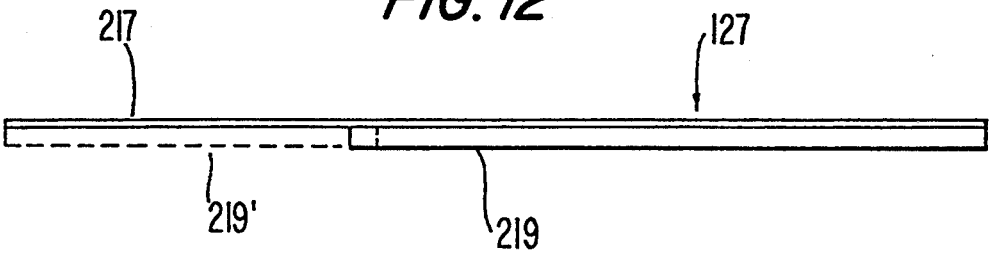
FIG. 12 is a top view of one of the folding plates of the folding plate assembly shown in FIGS. 10 and 11.

From FIGS. 10 and 11, it can be seen that side folding plates 127 run parallel with each other on opposite lateral sides of the package transfer path. Referring to FIG. 11, each plate 127 has a package lead-in portion 217 extending over elevator well 104. As seen in FIG. 12, an upper guide rail 219 protrudes inwardly from each side folding plate 127 and extends from the downstream end thereof to the edge of elevator well 104.

This design differs from the original Hayssen design as follows. In the latter, the upper guide rail 219 extends the length of lead-in portion 217, as depicted by the dotted line portion 219' in FIG. 12. In the present invention, portion 219' is removed. Portion 219' is unnecessary since compression plate 117, extending the length of the package, serves the purpose of holding down the lateral package edges and guiding the same into the side folding plates 127.

As a final preferred modification to the original Hayssen side folding plate design, the undersurface of shortened rail 219 is milled out ⅛" to provide additional clearance for edge portions 215 of plate 117 to pass thereunder as plate 117 moves with a package from above elevator well 104 to heat sealer 123.

To properly adjust the machine, the upper position of top compression plate 117 is set to the desired package height, using motion limiting clamps 211. Then, stationary plates 127 are adjusted to provide a small clearance (e.g. 1/16") between the undersurfaces of rails 219 and end portions 215 of plate 117.

Figure 9:
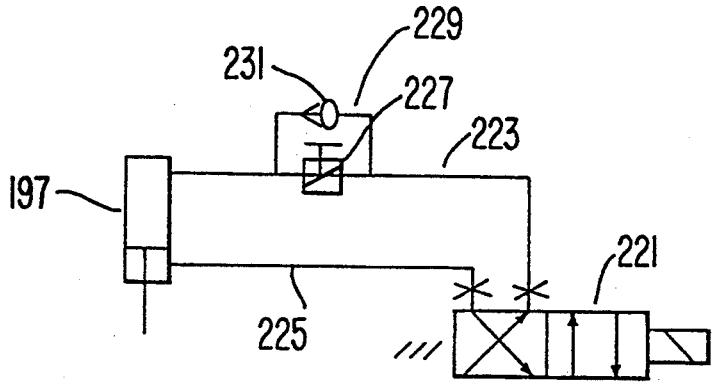
FIG. 9 is a schematic diagram illustrating the air flow control circuit of an actuating air cylinder of the top compression plate assembly shown in FIG. 8.

The control of air cylinder 197, and hence the raising and lowering of top compression plate 117, is now described with reference to FIG. 9. The air flow to and from air cylinder 197 is, similar to air cylinder 161, controlled by a standard four way—two position solenoid operated spring return vane 221, or alternatively with the other types of valves mentioned in connection with air cylinder 161. Valve 221 is operated in timed relation with the rotation of a cam shaft of the wrapping machine, by a programmable controller or other known switching arrangement. Adjustable flow controllers are placed in connecting lines 223 and 225 to allow for adjustment of the speed at which elevator plate 117 is raised and lowered. Preferably, these are set to control the air coming out of the cylinder.

A self relieving pressure regulator 227 is positioned in line 223 to regulate the maximum pressure generated in cylinder 197 during package compression. Should the pressure in cylinder 117 exceed the preset amount, pressure regulator 227 will bleed off air to reduce the pressure to the proper amount. In this manner, the maximum compressive force imparted to a package being wrapped may be controlled. A line 229 bypassing pressure regulator 227 includes a check valve 231. This arrangement allows air to escape freely from the top of air cylinder 197, through bypass 229, when valve 221 connects the air source with line 225 to raise air cylinder 197. On the other hand, when valve 221 connects the air source with line 223 to lower air cylinder 197, check valve 231 is maintained in its closed position by the line pressure, whereby regulator 227 is operative to control the pressure in air cylinder 197. The set point of pressure regulator 227 will depend on the desired amount of package compression. Typically, for a napkin package wrapping operation as described herein, this set point will be in the range of 10–25 psi. Preferably, the supply pressure (utilized to lift plate 117) is maintained between 20–30 psi.

With the present inventive process and apparatus, a high degree of package compression can be obtained in order to produce tight packages which do not become loose due to settling. Furthermore, occurrences of defective packages due to rolled or folded edges are at the same time significantly reduced. For example, the inventor has found that using the prior art Hayssen machine to produce napkin "twin packs", significantly bulked napkin stacks having a free standing height of $5\frac{1}{2}''$–$5\frac{3}{4}''$ could at most be reduced to a finished package height of $4\frac{1}{4}''$. With the machine set for this amount of compression, an unacceptably high rate of defects was experienced. In comparison, in wrapping identical napkin packages with an apparatus corresponding to the inventive apparatus described herein, and utilizing the inventive method, a finished napkin package height of between $3\frac{1}{4}''$ and $3\frac{3}{4}''$ was achieved with a very low defect rate.

The invention has been described in terms of presently preferred embodiments thereof. Other embodiments within the scope and spirit of the invention as defined in the appended claims will, given the benefit of this disclosure, occur to those having ordinary skill in the art.

I claim:

1. A package wrapping apparatus comprising:

a reciprocating elevator mechanism operative to move a package to be wrapped upwardly along a first path of the apparatus;

sheet feeding means for feeding a piece of wrapping material across said first path such that said package is draped with said wrapping material as it is moved therealong;

a top compression plate assembly comprising:

a compression plate located above said elevator mechanism, operative to compress said package after it has been draped in said wrapping material and as said package is moved upwardly by said elevator mechanism; and actuating means for moving said compression plate between a first lowered compressing position and a second elevated position; and a folding mechanism for folding the draped wrapping material against the package after it has been compressed, said folding mechanism comprising a pair of underfolders operative to move under opposite package edges once the elevator mechanism has moved the package thereabove;

wherein, said reciprocating elevator mechanism comprises:

a reciprocating elevator shaft;

an expandable elevator plate assembly mounted to and movable with said elevator shaft, said expandable elevator plate assembly comprising a fixed support member providing a first package support surface for supporting a first part of the package, and a first extension member providing a second package support surface for supporting an edge portion of the package, said first extension member being contractible for allowing the elevator plate assembly to avoid interference with said underfolders near the top of its stroke; and a bi-directional actuating mechanism mounted to and movable as a unit with said elevator plate assembly, said actuating mechanism being mounted to the bottom of said fixed support member and operative to move said first extension member in opposed directions between an extended position wherein said second package support surface extends laterally outwardly from said first package support surface, and a retracted position wherein said first extension member is located underneath and does not protrude laterally from said first package support surface; and wherein, said package wrapping apparatus further comprises control means for controlling said actuating mechanism, said actuating mechanism being operably connected to said control means by a control line extending from said control means to said actuating mechanism, and without rigid motion transmitting linkages.

2. A package wrapping apparatus according to claim 1, wherein:

said elevator mechanism reciprocates the elevator plate assembly up and down in a synchronized manner between a bottom position wherein a package can be received on said first and second support surfaces from a conveyor, and a top position wherein said support surfaces are positioned above said underfolders;

said control means and actuating mechanism are operative to move the first extension member to its retracted position when the elevator plate assembly is proximal the top of its stroke, thereby allowing the elevator plate assembly to pass freely below the underfolders during a downward stroke of the plate assembly, and to move the first extension member to its extended position during the downward stroke of the plate assembly, after the plate assembly has passed below the underfolders; and said actuating means is operative to position the compression plate in its first compressing position during at least a portion of an upward stroke of said elevator plate assembly, and to retract the compression plate to its second elevated position when the elevator plate is proximal the top of its stroke.

3. A package wrapping apparatus according to claim 2, wherein said first position of the compression plate is just above a plane of motion of said underfolders, and said second elevated position corresponds to a desired package height.

4. A package wrapping apparatus according to claim 3, wherein said folding mechanism further comprises package side folding means, and said apparatus further comprises a package transfer mechanism for transferring said package along a second path of the apparatus through said side folding means; and wherein said top compression plate assembly is mounted on said transfer mechanism for movement therewith, and said actuating means is operative to retain the compression plate in its second elevated position during a package transfer stroke of the transfer mechanism.

5. A package wrapping apparatus according to claim 4, wherein a package contacting surface of said top compression plate, and said package support surface, have substantially equal areas, whereby the entire upper and lower surfaces of said package may be covered during said compression thereof.

6. A package wrapping apparatus according to claim 2, wherein said actuating means comprises an air cylinder having a piston rod attached to said compression plate, and an air cylinder control circuit including a serf relieving pressure regulator for limiting a maximum pressure generated in said air cylinder during package compression.

7. A package wrapping apparatus according to claim 2, wherein said actuating mechanism comprises an air cylinder and said control means supplies air pressure to said air cylinder through a pair of air lines.

8. A package wrapping apparatus according to claim 7, wherein said fixed support member comprises a central package supporting plate and said first extension member is one of a pair of movable elevator support members operably connected to said air cylinder for movement between extended positions wherein each extends out from under opposite sides of said central package supporting plate, and retracted positions wherein each support member is retracted substantially beneath said central package supporting plate.

9. A package wrapping apparatus according to claim 8, wherein said pair of support members are operably connected to each other through a rack gear assembly.

10. A package wrapping apparatus according to claim 9, wherein said pair of support members are operably connected to each other through a pair of rack gear assemblies mounted to an underside of said central package supporting plate adjacent opposite ends thereof, and said rack gear assemblies are operably connected to each other by a shaft extending therebetween and having pinion gears mounted on opposite ends thereof which are engaged for rotation between respective pairs of rack gears of the two rack gear assemblies.

11. A package wrapping apparatus according to claim 10, wherein said air cylinder is mounted to an underside of said central package supporting plate, between the two rack gear assemblies and below said shaft.

12. A package wrapping apparatus according to claim 9, wherein said rack gear assembly includes two opposed rack gears and a pinion gear engaged for rotation between said opposed rack gears, and a housing block for housing the rack gears and pinion gear.

13. A package wrapping apparatus according to claim 12, wherein said housing block is formed of plastic material.

14. An expandable elevator plate assembly for a package wrapping apparatus, comprising:

a fixed support member providing a first package support surface;

a first extension member providing a second package support surface;

a bi-directional actuating mechanism for moving said first extension member in opposed directions between an extended position wherein said second package support surface extends laterally outwardly from said first package support surface, and a retracted position wherein said first extension member is located underneath and does not protrude laterally from said first package support surface, said actuating mechanism being mounted to the bottom of and movable as a unit with said fixed support member and having attached thereto a control line for operably connecting said actuating mechanism to control means for controlling said actuating mechanism, said actuating mechanism being controllable via said control line and without rigid motion transmitting linkages; and mounting means for mounting said elevator plate assembly to an elevator shaft.

15. An expandable elevator plate assembly according to claim 14, wherein said control line is a fluid line and said actuating mechanism is responsive to fluid pressure transmitted by said fluid line.

16. An expandable elevator plate according to claim 14, wherein said actuating mechanism comprises a housing member fixedly secured to said fixed support member and a rod mounted for rectilinear reciprocation within said housing member.

17. An expandable elevator plate assembly according to claim 16, wherein said control line is an air line and said housing comprises an air cylinder.

18. An expandable elevator plate assembly according to claim 17, wherein said control line comprises an air flow control circuit including a solenoid operated control valve for controlling operation of said air cylinder.

19. An expandable elevator plate assembly according to claim 14, further comprising impact surface means connected to an underside of said first extension member for causing retraction of the first extension member upon impact of an underfolder of the wrapping apparatus therewith.

20. An expandable elevator plate assembly according to claim 14, further comprising a second extension member providing a third package support surface, said second extension member being operably connected to said first extension member to move between an extended position wherein said third package support surface extends outwardly from said first package support surface, and a retracted position wherein said second extension member is located underneath and does not protrude laterally from said first package support surface.

21. An elevator plate assembly according to claim 20, wherein said first and second extension members extend, in their extended positions, out from opposite sides of said fixed support member, and in their retracted positions, are substantially beneath said opposite sides of the fixed support member.

22. An expandable elevator plate assembly according to claim 21, wherein said fixed support member comprises a thin top surface plate attached to a narrower underlying mounting plate in such a manner that opposite sides of the top surface plate overhang corresponding sides of said mounting plate, and said first and second extension members are movable underneath and out from under the overhanging sides of said top surface plate.

23. An expandable elevator plate assembly according to claim 22, wherein the first and second extension members are operably connected to each other through a pair of rack gear assemblies mounted to said underlying mounting plate adjacent opposite ends thereof, and said rack gear assemblies are operably connected with each other by a shaft extending therebetween and having pinion gears mounted on opposite ends thereof which are engaged for rotation between respective pairs of rack gears of the two rack gear assemblies.

24. An expandable elevator plate assembly according to claim 23, wherein said actuating mechanism is mounted to said underlying mounting plate between said rack gear assemblies, and below said shaft.

25. An expandable elevator plate assembly according to claim 24, wherein said housing is mounted to said mounting plate through a U-shaped spacer block providing clearance for said shaft to pass between said mounting plate and said actuating mechanism.

26. An expandable elevator plate assembly according to claim 21, wherein said first and second extension members are operably connected to each other through a motion reversing linkage, whereby motion of one of said extension members is translated into a corresponding opposing motion of the other extension member.

27. An expandable elevator plate assembly according to claim 26, wherein said motion reversing linkage comprises a rack gear assembly.

28. An expandable elevator plate assembly according to claim 27, wherein said rack gear assembly includes two opposed rack gears and a pinion gear engaged for rotation between said opposed rack gears, and a housing block for housing the rack gears and pinion gear.

29. An expandable elevator plate assembly according to claim 28, wherein said housing block is formed of plastic material.

30. An expandable elevator plate assembly according to claim 28, further comprising impact surface means connected to an underside of at least one of said first and second extension members, for causing retraction of said first and second extension members upon impact of an underfolder of the wrapping apparatus therewith.

31. An expandable elevator plate assembly according to claim 30, wherein said impact surface means comprises a spacer block attaching a lowermost one of said two opposed rack gears to one of said first and second extension members.

32. An expandable elevator plate assembly according to claim 31, wherein said impact surface means further comprises a block attached to and extending downwardly from an undersurface of an uppermost one of said two opposed rack gears attached to the other one of said first and second extension members.

33. An expandable elevator plate assembly for a package wrapping apparatus, comprising:

a fixed support member providing a first package support surface;

a first extension member providing a second package support surface, said first extension member being movable between an extended position wherein said second package support surface extends outwardly from said first package support surface, and a retracted position wherein said first extension member is retracted inwardly from said extended position;

a second extension member providing a third package support surface, said second extension member being operably connected to said first extension member to move between an extended position wherein said third package support surface extends outwardly from said first package support surface, and a retracted position wherein said second extension member is retracted inwardly from its extended position; and mounting means for mounting said elevator plate assembly to an elevator shaft;

wherein, said first and second extension members are operably connected to each other through a motion reversing linkage comprising a rack gear assembly mounted to and movable as a unit with said fixed support member, whereby motion of one of said extension members is translated into a corresponding opposing motion of the other extension member.

34. An expandable elevator plate assembly according to claim 33, wherein said rack gear assembly includes two opposed rack gears and a pinion gear engaged for rotation between said opposed rack gears, and a housing block for housing the rack gears and pinion gear.

35. An expandable elevator plate assembly according to claim 33, wherein said fixed support member comprises a thin top surface plate attached to a narrower underlying mounting plate in such a manner that opposite sides of the top surface plate overhang corresponding sides of said mounting plate, and said first and second extension members are movable underneath and out from under the overhanging sides of said top surface plate.

36. An expandable elevator plate assembly according to claim 35, wherein the first and second extension members are operably connected to each other through a pair of rack gear assemblies mounted to said underlying mounting plate adjacent opposite ends thereof, and said rack gear assemblies are operably connected with each other by a shaft extending therebetween and having pinion gears mounted on opposite ends thereof which are engaged for rotation between respective pairs of rack gears of the two rack gear assemblies.

37. A method of wrapping a soft compressible package utilizing an automated package wrapping apparatus, comprising the steps of:

moving a package to be wrapped upwardly along a first path of the apparatus, and thereby contacting said package with a piece of wrapping material placed across said first path such that said package is draped in said wrapping material;

compressing the draped package against a top plate positioned thereabove, during said upward movement along said first path, so as to compress the package to a height below a desired finished package height;

supporting the entire undersurface of the package during the compressing step, with an underlying plate of adjustable size;

advancing package underfolders of the apparatus underneath edges of the package once the package has been moved thereabove;

reducing the size of the underlying plate at approximately the top of the upward travel of the package, so as to enable the underlying plate to drop down between said underfolders;

withdrawing said top plate to an elevated position to substantially relieve the package of downward pressure applied thereto, approximately at the top of the upward travel of the package, to thereby allow the package to begin to recover to a desired package height;

performing and substantially completing a sliding transfer operation of the package to a sealing device, with said top plate withdrawn to its elevated position, before the compressed package has recovered fully to the desired package height; and sealing the package at said sealing device, once it has fully recovered to the desired package height.

38. A method according to claim 37, wherein said sliding transfer operation of the package transfers said package between side folding plates of the apparatus.

39. A method according to claim 37, wherein during the compressing step, the top plate is positioned just above a plane of motion of said underfolders, and said elevated position of the top plate corresponds to the desired package height.

40. A method according to claim 37, wherein the entire upper surface of the package is contacted by said top plate during the compressing step.

* * * * *